US010718534B2

(12) United States Patent
Kim et al.

(10) Patent No.: US 10,718,534 B2
(45) Date of Patent: Jul. 21, 2020

(54) AIR CONDITIONER HAVING AN IMPROVED OUTDOOR UNIT

(71) Applicant: SAMSUNG ELECTRONICS CO., LTD., Suwon-si, Gyeonggi-do (KR)

(72) Inventors: Kyung Hoon Kim, Suwon-si (KR); Sung Goo Kim, Suwon-si (KR); Tae Il Kim, Hwaseong-si (KR); Dong-Il Jung, Suwon-si (KR); Seung Kwan Choi, Yongin-si (KR); Jei-Min Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 446 days.

(21) Appl. No.: 15/331,068

(22) Filed: Oct. 21, 2016

(65) Prior Publication Data

US 2017/0115011 A1 Apr. 27, 2017

(30) Foreign Application Priority Data

Oct. 23, 2015 (KR) ..... 10-2015-0148069

(51) Int. Cl.
*F24F 1/16* (2011.01)
*F28F 1/32* (2006.01)
(Continued)

(52) U.S. Cl.
CPC ..... *F24F 1/16* (2013.01); *F24F 1/0003* (2013.01); *F28F 1/12* (2013.01); *F28F 1/32* (2013.01);
(Continued)

(58) Field of Classification Search
CPC .... F24F 1/16; F24F 1/0003; F24F 1/50; F28F 1/32; F28F 1/12; F28F 2215/04;
(Continued)

(56) References Cited

U.S. PATENT DOCUMENTS 1,911,522 A * 5/1933 McIntyre ..... F28D 1/024 165/122
2,148,238 A * 2/1939 Krackowizer ..... F25B 39/02 165/108
(Continued)

FOREIGN PATENT DOCUMENTS

CN 1664453 A 9/2005
CN 1952583 A 4/2007
(Continued)

OTHER PUBLICATIONS

International Search Report dated Dec. 14, 2016 in corresponding International Patent Application No. PCT/KR/011686.
(Continued)

*Primary Examiner* — Ljiljana V. Ciric
(74) *Attorney, Agent, or Firm* — Staas & Halsey LLP

(57) ABSTRACT

An air conditioner includes a heat exchanger including a refrigerant tube, a fin assembly, and a fan assembly located at an upper portion of the heat exchanger. The heat exchanger includes a first heat exchanger adjacent to the fan assembly and a second heat exchanger under the first heat exchanger. A density of a fin assembly at the first heat exchanger is larger than that of a fin assembly at the second heat exchanger. The heat exchanger may include a plurality of layers with a refrigerant introduced into each of inlet pipes of the heat exchanger flowing evenly at each of the layers. The refrigerant to be discharged to each of outlet pipes is discharged at the same temperature.

2 Claims, 10 Drawing Sheets

(51) Int. Cl.

| | |
|---|---|
| ***F24F 1/0003*** | (2019.01) |
| ***F28F 1/12*** | (2006.01) |
| ***F28D 1/02*** | (2006.01) |
| ***F28D 21/00*** | (2006.01) |
| ***F28D 1/047*** | (2006.01) |
| ***F24F 1/50*** | (2011.01) |

(52) U.S. Cl.
CPC ..... *F24F 1/50* (2013.01); *F28D 1/024* (2013.01); *F28D 1/0475* (2013.01); *F28D 2001/0273* (2013.01); *F28D 2021/0068* (2013.01); *F28F 2215/04* (2013.01)

(58) Field of Classification Search
CPC ..... F28D 1/0475; F28D 2021/0068; F28D 1/024; F28D 2001/0273
See application file for complete search history.

(56) References Cited

U.S. PATENT DOCUMENTS 2,612,357 A * 9/1952 Parks ..... B01F 3/04808 165/140
2,669,099 A * 2/1954 Malkoff ..... F25B 39/02 165/144
3,097,507 A * 7/1963 Makuh ..... F25B 39/02 165/144
3,212,288 A * 10/1965 Herbert ..... F24F 13/22 165/135
3,780,799 A * 12/1973 Pasternak ..... B21D 53/085 165/150
4,256,475 A * 3/1981 Schafer ..... F24D 11/0221 62/235.1
4,307,778 A * 12/1981 Tobin ..... F24F 1/18 165/125
4,337,823 A * 7/1982 DelPercio ..... F24H 3/062 165/122
4,429,734 A * 2/1984 Vandervaart ..... F24H 1/40 122/DIG. 3
4,434,843 A * 3/1984 Alford ..... F25B 39/00 165/150
4,470,271 A * 9/1984 Draper ..... F24F 1/16 165/124
4,475,152 A * 10/1984 Ikegame ..... G12B 15/02 257/E23.098
4,542,786 A * 9/1985 Anders ..... F28D 1/05366 165/144
4,567,733 A * 2/1986 Mecozzi ..... F24F 5/0007 165/140
4,574,868 A * 3/1986 Anders ..... F28D 1/05366 165/124
4,580,623 A * 4/1986 Smitte ..... F25B 39/02 165/150
4,671,347 A * 6/1987 MacCracken ..... F28D 20/021 165/10
4,674,293 A 6/1987 Clarke et al.
4,995,241 A * 2/1991 Vandervaart ..... F24H 4/06 165/240
5,484,015 A * 1/1996 Kyees ..... F25D 25/028 165/168
5,485,732 A * 1/1996 Locatelli ..... F25D 25/028 165/47
5,540,276 A * 7/1996 Adams ..... F28D 1/0477 165/150
5,613,554 A * 3/1997 Bull ..... F24F 13/22 165/122
5,647,431 A * 7/1997 Takeshita ..... F24F 1/0007 165/119
5,660,056 A * 8/1997 Arai ..... F24F 1/0007 165/122
5,806,585 A * 9/1998 Yoshida ..... B23K 1/0012 165/171
5,844,333 A * 12/1998 Sheerin ..... F28D 1/03 310/52
5,983,998 A * 11/1999 Kim ..... F28D 1/0477 165/122
6,053,238 A * 4/2000 Goth ..... F28D 1/0477 165/10
6,116,048 A * 9/2000 Hebert ..... F25B 39/02 62/524
6,598,295 B1 * 7/2003 Utter ..... B21D 53/085 165/151
7,032,411 B2 * 4/2006 Hebert ..... F25B 39/02 62/510
7,418,827 B2 * 9/2008 Rios ..... F24F 13/222 220/571
9,279,620 B2 * 3/2016 Edens ..... F24F 13/22
9,568,221 B2 * 2/2017 Suhara ..... F25B 13/00
9,625,217 B2 * 4/2017 Kim ..... F25B 39/00
10,145,621 B2 * 12/2018 Anderson ..... F28F 1/00
10,151,537 B2 * 12/2018 Lee ..... F22B 37/101
10,156,406 B2 * 12/2018 Lee ..... F28F 13/06
10,234,178 B2 * 3/2019 Schutte ..... F25B 39/02
2004/0118151 A1 * 6/2004 Hebert ..... F25B 39/02 62/524
2005/0257558 A1 * 11/2005 Yoshioka ..... B82Y 30/00 62/324.5
2007/0125528 A1 * 6/2007 Fakheri ..... F28D 1/024 165/163
2010/0326643 A1 * 12/2010 Hancock ..... F25B 39/00 165/181
2012/0011873 A1 * 1/2012 Blackstone ..... F24F 13/30 62/259.3
2013/0192809 A1 * 8/2013 Kim ..... F25B 39/00 165/175
2014/0196874 A1 7/2014 Miyake et al.
2014/0216699 A1 * 8/2014 Lee ..... F28D 7/024 165/163
2015/0107803 A1 4/2015 Ikeda et al.
2015/0354838 A1 * 12/2015 Cur ..... F24F 1/0003 62/426
2016/0313066 A1 * 10/2016 Andersson ..... F28F 3/046
2017/0059188 A1 * 3/2017 Hancock ..... F24F 1/0059
2018/0106559 A1 * 4/2018 Kester ..... F28F 9/262
2018/0135915 A1 * 5/2018 Kester ..... F28F 1/24
2018/0209742 A1 * 7/2018 Jiang ..... F28D 1/05341
2018/0363988 A1 * 12/2018 Liu ..... F28F 9/0243
2019/0011171 A1 * 1/2019 Kang ..... F25B 39/022
2019/0011192 A1 * 1/2019 He ..... F28F 9/02
2019/0145715 A1 * 5/2019 Berthelot ..... F28F 1/20
2019/0154341 A1 * 5/2019 Yamamoto ..... F24F 13/30
2019/0154342 A1 * 5/2019 Jin ..... F28D 1/0443
2019/0170372 A1 * 6/2019 Yoshioka ..... F25B 39/00
2019/0170451 A1 * 6/2019 Yokozeki ..... F28F 9/0275
2020/0132381 A1 * 4/2020 Kester ..... F28F 1/24

FOREIGN PATENT DOCUMENTS

| | | | |
|---|---|---|---|
| CN | 103957682 | A | 7/2014 |
| CN | 104321610 | A | 1/2015 |
| CN | 104807087 | A | 7/2015 |
| DE | 101 02 640.4 | | 7/2002 |
| EP | 2 157 389 | A1 | 2/2010 |
| EP | 2 902 717 | A1 | 8/2015 |
| JP | 10-332221 | | 12/1998 |
| JP | 2907864 | | 6/1999 |
| JP | 2003-74892 | | 3/2003 |
| JP | 2006-29734 | | 2/2006 |
| JP | 2006-132846 | | 5/2006 |
| JP | 2013-2683 | | 1/2013 |
| KR | 10-2004-0098278 | | 11/2004 |
| KR | 10-2012-0081815 | | 7/2012 |
| KR | 10-2014-0060697 | | 5/2014 |
| KR | 10-2015-0017069 | | 2/2015 |
| WO | WO 2015/063989 | | 5/2015 |

OTHER PUBLICATIONS

Russian Search Report (Office Action) issued in Application No. 2018114678/12(022957), PCT/KR2016/011686, dated Nov. 23, 2018 (2 pages).

(56) References Cited

OTHER PUBLICATIONS

Australian Patent Office issued Examination 1st Report in Application No. 2016340648 dated Nov. 1, 2018 (3 pages).
Russian Patent Office issued Office Action in Application No. 2018114678 dated Nov. 23, 2018 (5 total pages).
Russian Search Report (Office Action) issued in Application No. 2018114678/12(022957), PCT/KR2016/011686, dated Nov. 23, 2018 (2 pages) (translation).
European Search Report in Application No. 16857742.7 dated Sep. 19, 2018 (6 pages).
Russian Office Action dated Mar. 27, 2019 in corresponding Russian Patent Application No. 2018114678/12(022957) (8 pages).
Chinese Office Action dated Aug. 26, 2019 in related Chinese Application No. 201680061603.X.
Indian Office Action dated Nov. 11, 2019 in related Indian Application No. 201817015169.
Chinese Office Action dated Apr. 15, 2020 in Chinese Patent Application No. 201680061603.X.

* cited by examiner

AIR CONDITIONER HAVING AN IMPROVED OUTDOOR UNIT

CROSS-REFERENCE TO RELATED APPLICATIONS

This application claims the priority benefit of Korean Patent Application No. 10-2015-0148069, filed on Oct. 23, 2015 in the Korean Intellectual Property Office, the disclosure of which is incorporated herein by reference.

BACKGROUND

1. Field

Embodiments of the present invention relate to an outdoor unit having improved performance and an air conditioner with the same.

2. Description of the Related Art

In general, an air conditioner is an apparatus for keeping indoor air fresh using a refrigeration cycle to be suitable for human activities. A typical air conditioner may cool or heat air around a heat exchanger according to a phase change of a refrigerant flowing through the heat exchanger and may discharge the cooled or heated air into a room, thereby keeping an indoor temperature appropriately.

Such an air conditioner has the refrigeration cycle in which the refrigerant is circulated through a compressor, a condenser, an expansion valve and an evaporator in a normal direction or a reverse direction. The compressor provides a high temperature and high pressure gas refrigerant, and the condenser provides a room temperature and high pressure liquid refrigerant. The expansion valve depressurizes the room temperature and high pressure liquid refrigerant, and the evaporator evaporates the depressurized refrigerant into a low temperature gas state.

The air conditioner may be classified into a separate type air conditioner in which an indoor unit and an outdoor unit are separately installed, and an integrated type air conditioner in which the indoor unit and the outdoor unit are integrally installed.

SUMMARY

Therefore, it is an aspect of the present invention to provide an outdoor unit having enhanced heat exchange efficiency and an air conditioner with the same.

Additional aspects and/or advantages will be set forth in part in the description which follows and, in part, will be apparent from the description, or may be learned by practice of the invention.

In accordance with an aspect of the present invention, an air conditioner includes an outdoor unit including a heat exchanger and a fan assembly, wherein the heat exchanger is configured with a plurality of layers each of which includes a plurality of refrigerant tubes and a fin assembly, and the heat exchanger includes a first layer and a second layer, and a first refrigerant tube of the first layer is connected to a first refrigerant tube and a second refrigerant tube of the second layer at one end of the heat exchanger.

The heat exchanger may further include a third layer, and at the other end of the heat exchanger, the first refrigerant tube of the second layer may be connected to a first refrigerant tube of the third layer and the second refrigerant tube of the second layer may be connected to a second refrigerant tube of the third layer.

At the other end of the heat exchanger, the first refrigerant tube of the first layer may be connected to a second refrigerant tube of the first layer.

The heat exchanger may further include a refrigerant pipe connected to the second refrigerant tube of the first layer at one end of the heat exchanger.

The heat exchanger may further include a refrigerant pipe connected to the first refrigerant tube of the third layer and the second refrigerant tube of the third layer at the other end of the heat exchanger.

The plurality of refrigerant tubes of the first layer and the plurality of refrigerant tubes of the second layer may be disposed forward and backward to be alternated with each other and thus not to be overlapped.

The refrigerant tubes of the second layer and the third layer may be disposed forward and backward to be alternated with each other and thus not to be overlapped.

The first refrigerant tube of the first layer and the second refrigerant tube of the first layer may be connected by a U-shaped connection pipe.

The first refrigerant tube of the first layer, the first refrigerant tube of the second layer and the second refrigerant tube of the second layer may be connected by a tripod-shaped connection pipe.

The first refrigerant tube of the second layer and the first refrigerant tube of the third layer may be diagonally connected by a U-shaped connection pipe, and the second refrigerant tube of the second layer and the second refrigerant tube of the third layer may be diagonally connected by the U-shaped connection pipe.

In accordance with another aspect of the present invention, an air conditioner includes an outdoor unit including a heat exchanger and a fan assembly, wherein the heat exchanger includes a first layer, a second layer and a third layer which are stacked forward and backward and each of which includes a plurality of refrigerant tubes and a fin assembly, and is formed so that a refrigerant flowing reciprocatingly at the first layer is distributed to two refrigerant tubes of the second layer and flows in one direction and the refrigerant flowed through the second layer in one direction is delivered to the third layer and flows in one direction.

The fan assembly may be disposed at an upper portion of the heat exchanger, and the heat exchanger may include a plurality of heat exchanger units disposed vertically.

The plurality of heat exchanger units may include fin assemblies configured with fins having different fin pitches or different shapes.

The heat exchanger may include a first heat exchanger unit disposed adjacent to the fan assembly and a second heat exchanger unit disposed under the first heat exchanger unit, and the fin assembly of the first heat exchanger unit may be configured with a high-speed fin having a fin pitch and a fin shape which are advantageous to a high-speed air flow, and the fin assembly of the second heat exchanger unit may be configured with a low-speed fin having a fin pitch and a fin shape which are advantageous to a low-speed air flow.

The fin pitch of the fin assembly of the first heat exchanger unit may be formed smaller than that of the fin assembly of the second heat exchanger unit.

A heat exchange fin of the fin assembly of the first heat exchanger unit may be formed in a shape having a wider area and higher resistance to air than those of a heat exchange fin of the fin assembly of the second heat exchanger unit.

The fin pitch of the fin assembly of the first heat exchanger unit may be formed smaller than that of the fin assembly of the second heat exchanger unit, and a heat exchange fin of the fin assembly of the first heat exchanger unit may be formed in a shape having a wider area and higher resistance to air than those of a heat exchange fin of the fin assembly of the second heat exchanger unit.

The heat exchanger may include a first heat exchanger unit disposed adjacent to the fan assembly, a second heat exchanger unit disposed under the first heat exchanger unit, a first refrigerant pipe connected to the refrigerant tubes of the first layer of the first heat exchanger unit, a second refrigerant pipe connected to the refrigerant tubes of the first layer of the second heat exchanger unit, a first valve unit configured to control the refrigerant flowing to the first refrigerant pipe, and a second valve unit configured to control the refrigerant flowing to the second refrigerant pipe.

The first valve unit may include a first expansion valve configured to expand the refrigerant when the refrigerant is introduced into the first refrigerant pipe and a first check valve configured to allow a flow of the refrigerant in only a discharging direction when the refrigerant is discharged from the first refrigerant pipe, and the second valve unit may include a second expansion valve configured to expand the refrigerant when the refrigerant is introduced into the second refrigerant pipe and a second check valve configured to allow a flow of the refrigerant in only a discharging direction when the refrigerant is discharged from the second refrigerant pipe.

An amount of the refrigerant per unit time which flows through the first valve unit may be greater than that of the refrigerant per unit time which flows through the second valve unit.

The fan assembly may be disposed at an upper portion of the heat exchanger, and at least one of the first layer, the second layer and the third layer of the heat exchanger may include a plurality of fin assemblies disposed vertically and configured with heat exchange fins having different fin pitches or different shapes.

The plurality of fin assembles may include a first fin assembly disposed adjacent to the fan assembly and a second fin assembly disposed under the first fin assembly, and the first fin assembly may be configured with high-speed fins having a fin pitch and a fin shape which are advantageous to a high-speed air flow, and the second fin assembly may be configured with low-speed fins having a fin pitch and a fin shape which are advantageous to a low-speed air flow.

The fin assemblies of at least two of the first layer, the second layer and the third layer of the heat exchanger may be configured with heat exchange fins having different fin pitches or different shapes.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
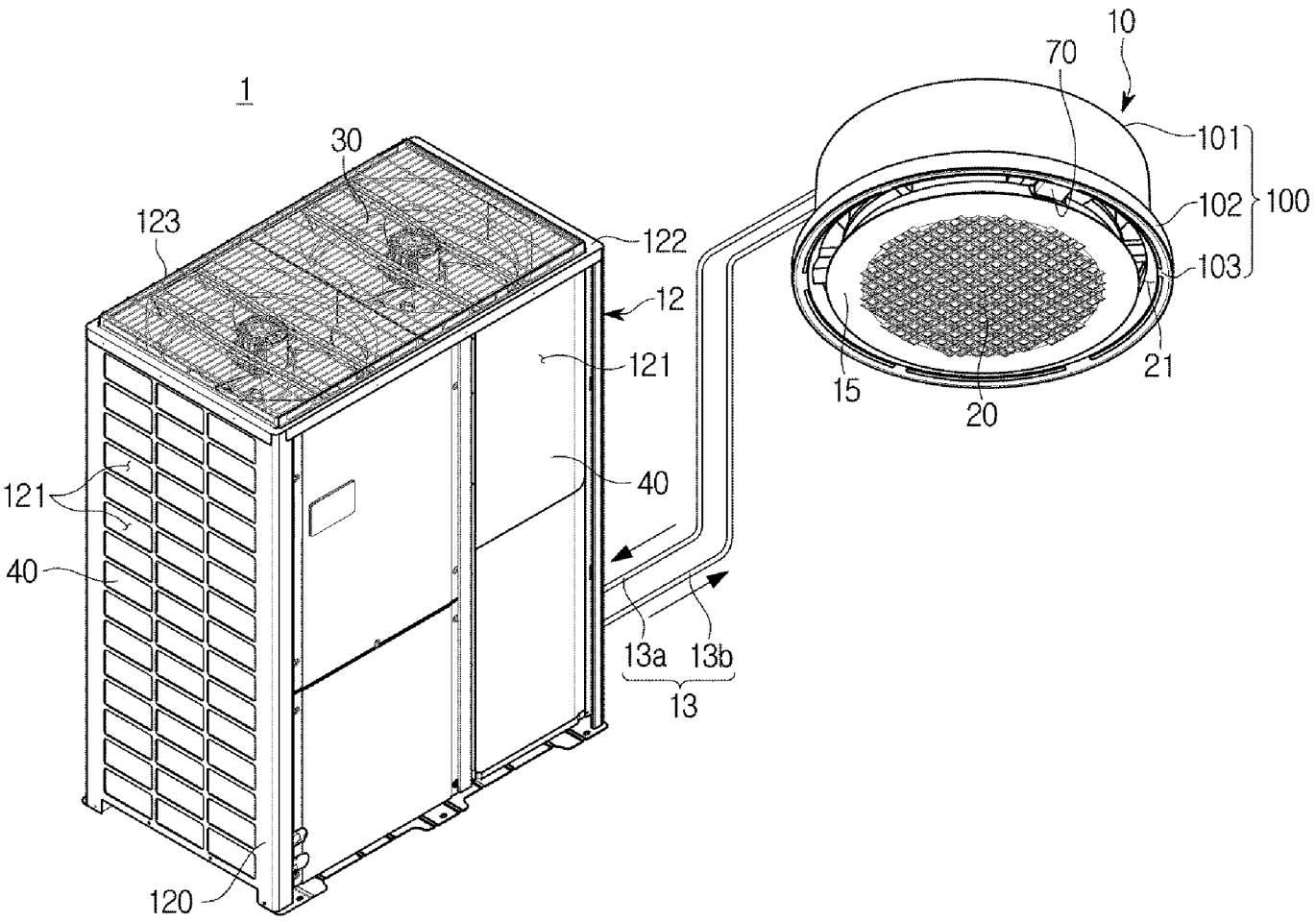
FIG. 1 is a view illustrating an air conditioner according to an embodiment.

Reference will now be made in detail to the embodiments, examples of which are illustrated in the accompanying drawings, wherein like reference numerals refer to the like elements throughout. The embodiments are described below to explain the present invention by referring to the figures.

The embodiments disclosed herein and configurations illustrated in the specification and the drawings are only the most preferable embodiment, and other various equivalents and modifications capable of substituting for the embodiments and the drawings of the specification may exist at the filing time point of the invention.

Also, like reference numerals or symbols refer to substantially like or corresponding elements or configurations in each of the drawings in the specification.

Also, the terms used in the specification are used to explain the embodiments, and it is understood that terms "comprises", "includes" or "has" are intended to indicate the presence of features, numerals, steps, operations, elements and components described in the specification or the presence of combinations of these, and do not preclude the presence of one or more other features, numerals, steps, operations, elements and components, the presence of combinations of these, or additional possibilities.

Also, the terms including ordinal numbers such as "first," "second," etc. can be used to describe various components, but the components are not limited by those terms. The terms are used merely for the purpose of distinguishing one component from another. For example, a first component may be called a second component, and similarly, a second component may be called a first component without departing from the scope of rights of the invention. The term "and/or" encompasses combinations of a plurality of items or any one of the plurality of items.

Hereinafter, an outdoor unit and an air conditioner with the same according to an embodiment will be described in detail with reference to the drawings.

FIG. 1 is a view illustrating an air conditioner according to an embodiment.

Referring to FIG. 1, an air conditioner 1 according to an embodiment of the present invention includes an indoor unit 10, e.g., indoor portion of the air conditioner and an outdoor unit 12, e.g., outdoor portion of the air conditioner. The indoor unit 10 and the outdoor unit 12 may be connected to each other by a refrigerant pipe 13. The air conditioner 1 may be an air conditioner for both cooling and warming. The air conditioner 1 may be an air conditioner for only cooling or warming. Hereinafter, an example in which the air conditioner 1 performs the warming will be described.

The refrigerant pipe 13 may include a first refrigerant pipe 13*b* and a second refrigerant pipe 13*a*. The refrigerant evaporated in the outdoor unit 12 may be moved to the indoor unit 10 through the first refrigerant pipe 13*b*. The refrigerant for exchanging heat with indoor air in the indoor unit 10 may be moved to the outdoor unit 12 through the second refrigerant pipe 13*a*. The refrigerant may be circulated between a refrigerant tube provided at the indoor unit 10 and a refrigerant tube provided at the outdoor unit 12 through the refrigerant pipe 13.

The indoor unit 10 may maintain an indoor temperature at an appropriate temperature by discharging the air exchanged heat with the refrigerant expanded and evaporated in the outdoor unit 12 into an indoor space. The indoor unit 10 may include a heat exchanger. Indoor air may be heated by discharging the air heated by the refrigerant condensed in the heat exchanger into the indoor space. A fan assembly for blowing cooled air so that the air heated by the refrigerant is smoothly discharged into the indoor space may be provided at the indoor unit 10. As an air volume of the fan assembly is increased, warming performance may be further enhanced.

The indoor unit 10 may be installed at a ceiling. At least a part of the indoor unit 10 of the air conditioner 1 may be in the ceiling.

The indoor unit 10 of the air conditioner 1 includes a housing 100 having an inlet port 20 and an outlet port 21. The housing 100 may have an approximately circular shape when being seen in a vertical direction. The housing 100 may include an upper housing 101 disposed inside the ceiling, a middle housing 102 coupled to a lower side of the upper housing 101, and a lower housing 103 coupled to a lower side of the middle housing 102.

The inlet port 20 through which the air may be suctioned is formed at a center of the lower housing 103, and the outlet port 21 through which the air is discharged may be formed at an radial outside of the inlet port 20. The outlet port 21 may have an approximately circular shape when being seen in a vertical direction. The outlet port 21 may include a plurality of arc shapes spaced apart from each other by a bridge 70 when being seen in the vertical direction.

The indoor unit 10 of the air conditioner 1 may suction the air from a lower side thereof, may cool and heat the air and then may discharge again the air through the lower side thereof. A grille 15 may be coupled to a lower surface of the lower housing 103 to filter dust from the air suctioned through the inlet port 20.

As the air volume blown by the fan assembly is increased, performance of the indoor unit 10 may be enhanced. As the air volume of the fan assembly is increased, the cooled air may reach a position which is further distant from the indoor unit 10, and a temperature of the indoor air may be increased very soon.

The outdoor unit 12 may include housings 120 and 122 forming an exterior. The housings 120 and 122 may include a side housing 120 and an upper housing 122. A heat exchanger and a fan assembly 30 may be provided inside the housings 120 and 122. The heat exchanger serves to evaporate a refrigerant, and at this point, the refrigerant absorbs external heat.

An inlet port 121 through which external air is introduced inside the outdoor unit 12 may be formed at the outdoor unit 12. An outlet port 123 through which the air exchanged heat with the heat exchanger is discharged may be further formed at the outdoor unit 12. For example, the inlet port 121 may be formed at the side housing 120. The outlet port 123 may be formed at the upper housing 122. The fan assembly 30 may be provided at a side of the outlet port 123 so that the air introduced through the inlet port 121 is blown to be discharged through the outlet port 123 via the heat exchanger.

A plurality of indoor units 10 may be connected to the outdoor unit 12. When the plurality of indoor units 10 are connected, an amount of the refrigerant which will exchange heat is increased, and thus a capacity of the heat exchanger should be increased further than that of the heat exchanger in the case in which one indoor unit 10 is connected to the outdoor unit 12. However, since there is a limitation in increasing the capacity of the heat exchanger, the outdoor unit 12 having excellent heat exchange efficiency is required.

Figure 2:
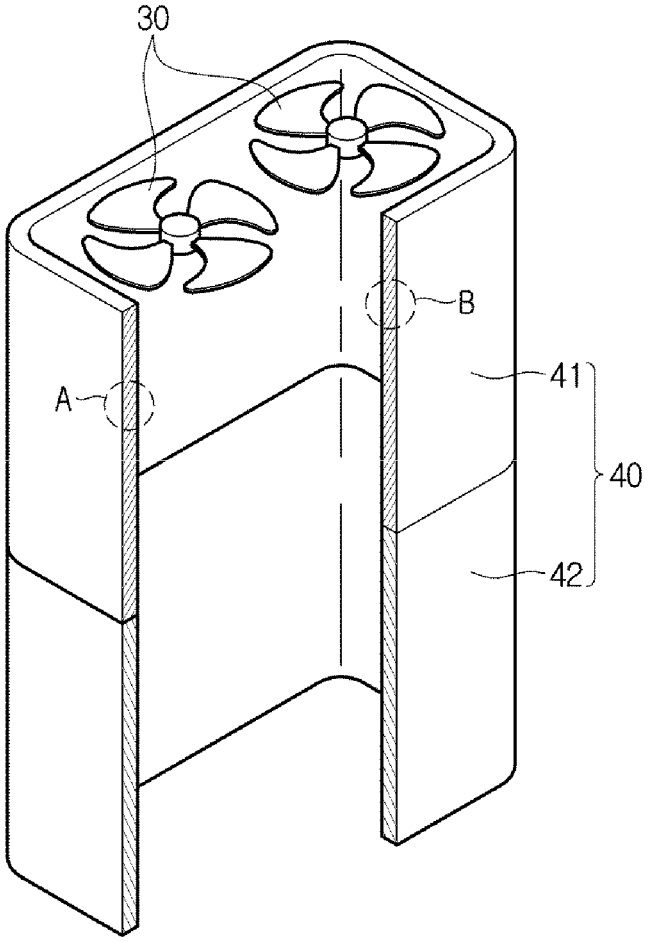
FIG. 2 is a view illustrating a heat exchanger and a fan assembly of an outdoor unit according to an embodiment.
Figure 3:
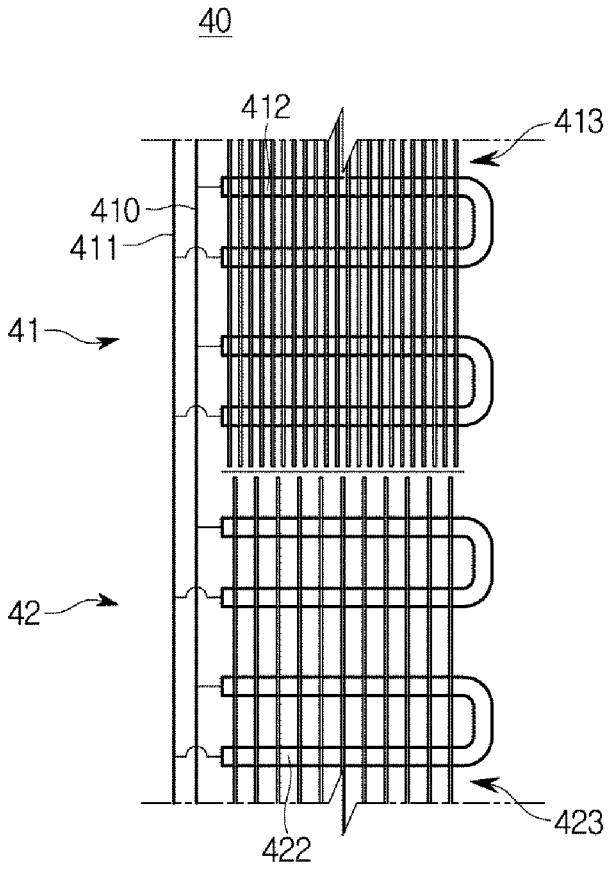
FIG. 3 is a view schematically illustrating one side surface of the heat exchanger according to an embodiment.
Figure 4A:
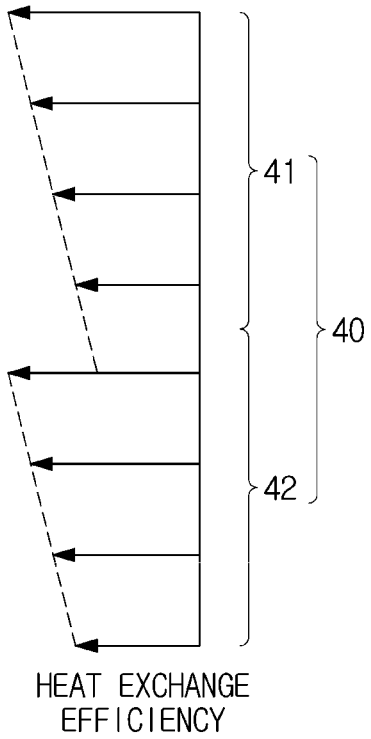
FIG. 4A is a view illustrating a change in heat exchange efficiency with respect to a height of the outdoor unit according to an embodiment.
Figure 4B:
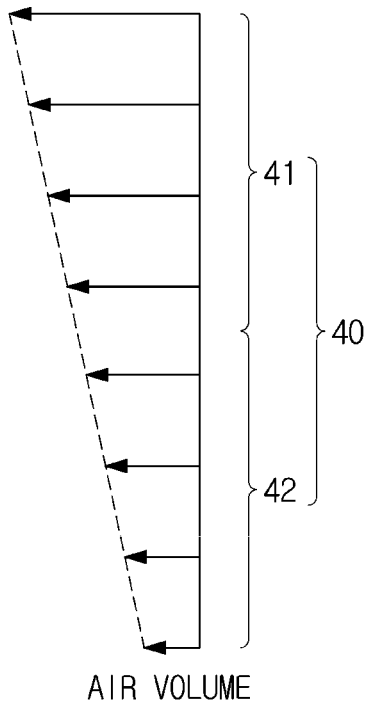
FIG. 4B is a view illustrating a change in an air volume with respect to the height of the outdoor unit according to an embodiment.

FIG. 2 is a view illustrating the heat exchanger and the fan assembly of the outdoor unit according to an embodiment, FIG. 3 is a view schematically illustrating one side surface of the heat exchanger according to an embodiment, FIG. 4A is a view illustrating a change in heat exchange efficiency with respect to a height of the outdoor unit according to an embodiment, and FIG. 4B is a view illustrating a change in an air volume with respect to the height of the outdoor unit according to an embodiment.

Referring to FIGS. 2 to 4B, the outdoor unit 12 according to an embodiment may include a heat exchanger 40 and the fan assembly 30. The fan assembly 30 may be located at an upper portion of the heat exchanger 40.

The heat exchanger 40 may be disposed along an inner perimeter of the side housing 120. The heat exchanger 40 may be provided at one inner surface of the side housing 120, or may be provided along two or more inner surfaces of the side housing 120 to increase the heat exchange efficiency.

Since the fan assembly 30 is located at a side of the outlet port 123 located at an upper portion of the outdoor unit 12, a flow speed at a lower portion of the outdoor unit 12 may be slower than that at an upper portion thereof (see, for example, FIG. 4B). Due to such a non-uniform distribution of the flow speed, heat exchange performance of the heat exchanger 40 may not be good. Since the heat exchange performance at the lower portion of the heat exchanger 40 may be poor, it is necessary to improve the heat exchange performance.

In the heat exchanger 40 according to an embodiment of the present invention, a plurality of heat exchanger units 41 and 42, which are different types from each other, may be disposed vertically to enhance the heat exchange performance at the lower portion of the heat exchanger 40. Fin assemblies forming the plurality of different types of heat exchanger units 41 and 42 may have different fin pitches from each other and may be configured with fins having different shapes. An embodiment in which the first heat exchanger unit 41 and the second heat exchanger unit 42 of the heat exchanger 40 are disposed vertically will is described. The number of different types of heat exchangers included in the outdoor unit 12 is not limited thereto.

The heat exchanger 40 may include the first heat exchanger unit 41 located at an upper portion thereof and the second heat exchanger unit 42 located at a lower portion of the first heat exchanger unit 41. That is, the first heat exchanger unit 41 may be disposed adjacent to the fan assembly 30, and the second heat exchanger unit 42 may be disposed at the lower portion of the first heat exchanger unit 41.

The first heat exchanger unit 41 includes a plurality of refrigerant tubes 412 and a fin assembly 413. The fin assembly 413 may be coupled to outer surfaces of the plurality of refrigerant tubes 412. Each of refrigerant pipes 410 and 411 for distributing the refrigerant to the plurality of refrigerant tubes 412 or collecting the refrigerant from the plurality of refrigerant tubes 412 may be provided at one end of each of the plurality of refrigerant tubes 412.

Each of the refrigerant tubes 412 may be formed in a cylindrical shape or a flat plate shape. A passage through which the refrigerant flows may be provided inside each of the refrigerant tubes 412. The plurality of refrigerant tubes 412 may be vertically stacked to be spaced apart from each other at regular intervals.

The refrigerant may exchange heat with the external air while a phase thereof is changed (condensed) from a gas state into a liquid state, or may exchange heat with the external air while the phase thereof is changed (evaporated) from the liquid state into the gas state. When the phase of the refrigerant is changed from the gas state into the liquid state, the heat exchanger 40 is used as a condenser, and when the refrigerant is changed from the liquid state into the gas state, the heat exchanger 40 is used as an evaporator.

The refrigerant pipes 410 and 411 may include a first refrigerant pipe 410 and a second refrigerant pipe 411. The first refrigerant pipe 410 and the second refrigerant pipe 411 may be connected to one end of each of the plurality of refrigerant tubes 412, and the other end of the refrigerant tube 412 of which one end is connected to the first refrigerant pipe 410 and the other end of the refrigerant tube 412 of which one end is connected to the second refrigerant pipe 411 are connected through a U-shaped connection pipe so that the plurality of refrigerant tubes 412 are in communication with each other. The first refrigerant pipe 410 and the second refrigerant pipe 411 may be coupled to one end of each of the plurality of refrigerant tubes 412 so that the plurality of refrigerant tubes 412 are in communication with each other, and thus the refrigerant may flow through the plurality of refrigerant tubes 412. Each of the first refrigerant pipe 410 and the second refrigerant pipe 411 may be formed in a hollow pipe shape.

The refrigerant is condensed or evaporated through the passage formed in the refrigerant tubes 412 to radiate or absorb heat therearound. The fin assembly 413 may be coupled to the refrigerant tubes 412 so that the refrigerant efficiently radiates or absorbs heat when being condensed or evaporated.

A heat exchange fin forming the fin assembly 413 may be disposed to extend in a stacked lengthwise direction of the refrigerant tubes 412. That is, when the refrigerant tubes 412 are vertically stacked, the heat exchange fin forming the fin assembly 413 may be disposed to extend in the vertical direction and thus to cross the refrigerant tubes 412. A plurality of heat exchange fins of the fin assembly 413 may be provided to be spaced apart from each other at regular intervals. The fin assembly 413 may be bonded to the outer surfaces of the refrigerant tubes 412 and to increase a heat exchange area between the external air passing through the fin assembly 413 and the refrigerant tubes 412. The fin assembly 413 may guide condensate water generated at surfaces of the refrigerant tubes 412 to flow downward.

The second heat exchanger unit 42 includes a plurality of refrigerant tubes 422 and a fin assembly 423. The fin assembly 423 may be coupled to outer surfaces of the plurality of refrigerant tubes 422. One end of each of the plurality of refrigerant tubes 422 may be connected to the refrigerant pipes 410 and 411. The refrigerant tubes 422 and the refrigerant pipes 410 and 411 may be applied similarly to the refrigerant tubes 412 and the refrigerant pipes 410 and 411 in the first heat exchanger unit 41.

The fin assembly 413 of the first heat exchanger unit 41 may be formed as a high speed fin having a fin pitch and a fin shape that are advantageous to a high-speed air flow, and the fin assembly 423 of the second heat exchanger unit 42 is formed a low speed fin having a fin pitch and a fin shape that are advantageous to a low-speed air flow.

As an embodiment, a density of the fin assembly 423 at the second heat exchanger unit 42 may be lower than that of the fin assembly 413 at the first heat exchanger unit 41. That is, the fin assembly 413 at the first heat exchanger unit 41 may have a smaller distance between the heat exchange fins, i.e., a smaller fin pitch than that of the fin assembly 423 at the second heat exchanger unit 42.

Since the density of the fin assembly 413 at the first heat exchanger unit 41 is higher than that of the fin assembly 423 at the second heat exchanger unit 42, a heat exchange amount per unit time between the fin assembly 413 and the air passing through the first heat exchanger unit 41 may be greater than that between fin assembly 423 and the air passing through the second heat exchanger unit 42.

Since the first heat exchanger unit 41 may be located at an upper portion of the heat exchanger 40 to be closer to the fan assembly 30, the flow speed of the air at a side of the first heat exchanger unit 41 may be faster than that of the air at a side of the second heat exchanger unit 42. Therefore, the fin assembly 413 at the side of the first heat exchanger unit 41 may be densely disposed so that the heat exchange is performed at a high speed. However, due to the fin assembly 413 having the fin pitch smaller than that of the fin assembly 423 of the second heat exchanger unit 42, the air passing through the first heat exchanger unit 41 may have higher resistance that that at the second heat exchanger unit 42.

The fin assembly 423 having a larger fin pitch than that of the fin assembly 413 of the first heat exchanger unit 41 may be disposed at the second heat exchanger unit 42. Since the flow of the air at the second heat exchanger unit 42 by the fan assembly 30 may be slower than that of the air at the first heat exchanger unit 41, the fin assembly 423 may have a heat exchange fin having a larger fin pitch than that of the heat exchange fin of the fin assembly 413 of the first heat exchanger unit 41 to reduce the resistance when the air flows. Accordingly, the heat exchange efficiency at the first heat exchanger unit 41 and the second heat exchanger unit 42 may be relatively evenly achieved.

As illustrated in FIG. 4A, the heat exchange efficiency at the second heat exchanger unit 42 may have a similar pattern to that of the heat exchange efficiency at the first heat exchanger unit 41. Since the flow speed may be gradually reduced from an upper portion of the first heat exchanger unit 41 toward a lower portion thereof, the heat exchange efficiency at the first heat exchanger unit 41 may be gradually reduced from the upper portion thereof toward the lower portion thereof. Since the flow speed may be gradually reduced toward a lower portion of the second heat exchanger unit 42, the heat exchange efficiency at the second heat exchanger unit 42 may be gradually reduced from the upper portion thereof toward the lower portion thereof.

Since the fin assembly 413 having a smaller fin pitch may be disposed at the first heat exchanger unit 41 located at the upper side and the fin assembly 423 having a larger fin pitch than that of the first heat exchanger unit 41 may be disposed at the second heat exchanger unit 42 located at the lower side, the heat exchange may be evenly performed at the first heat exchanger unit 41 and the second heat exchanger unit 42.

Figure 5:
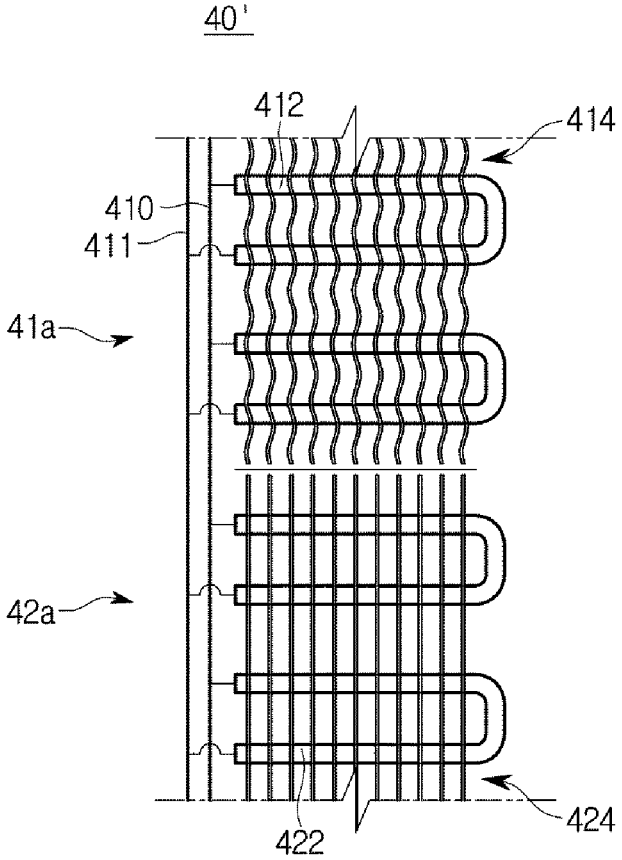
FIG. 5 is a view schematically illustrating one side surface of a heat exchanger according to another embodiment.

FIG. 5 is a view schematically illustrating one side surface of a heat exchanger according to another embodiment.

As illustrated in FIG. 5, a heat exchanger 40' according to an embodiment may include a first heat exchanger unit 41*a* located at an upper side thereof and a second heat exchanger unit 42*a* located under the first heat exchanger unit 41*a*. The first heat exchanger unit 41*a* and the second heat exchanger unit 42*a* may include a plurality of refrigerant tubes 412 and 422 and fin assemblies 414 and 424 coupled to outer surfaces of the plurality of refrigerant tubes 412 and 422, respectively. Each of refrigerant pipes 410 and 411 may be provided at each of one ends of the plurality of refrigerant tubes 412 and 422.

A heat exchange fin of the fin assembly 414 provided at the first heat exchanger unit 41*a* may be formed in a shape having a wider area and higher resistance to the air than those of a heat exchange fin of the fin assembly 424 provided at the second heat exchanger unit 42*a*.

For example, when the heat exchange fin of the fin assembly 424 provided at the second heat exchanger unit 42*a* may be formed in a plate shape, the heat exchange fin of the fin assembly 414 provided at the first heat exchanger unit 41*a* may be formed in a curved surface shape. As another example, the heat exchange fin of the fin assembly 414 provided at the first heat exchanger unit 41*a* may be formed in a slit shape or may be formed in a shape having a protruding portion.

A shape of the heat exchange fin of the fin assembly 414 provided at the first heat exchanger unit 41*a* and a shape of the heat exchange fin of the fin assembly 424 provided at the second heat exchanger unit 42*a* are not limited to the above-described shapes.

A flow speed at the first heat exchanger unit 41*a* may be faster than that at the second heat exchanger unit 42*a* due to an influence of the fan assembly 30. Therefore, the first heat exchanger unit 41*a* may be formed so that a contact area between the fin assembly 414 and the air may be increased and thus the heat exchange between the fin assembly 414 and the air may be rapidly performed.

The second heat exchanger unit 42*a* may be less influenced by the fan assembly 30 than the first heat exchanger unit 41*a* may be, and thus the flow speed may be slow. Therefore, the fin assembly 424 provided at the second heat exchanger unit 42*a* may be provided to reduce the resistance to the air.

Since the fin assembly 414 provided at the first heat exchanger unit 41*a* may be formed to have a wider surface area and a higher resistance than those of the fin assembly 424 provided at the second heat exchanger unit 42*a*, the heat exchange at the side of the first heat exchanger unit 41*a* and the side of the second heat exchanger unit 42*a* may be relatively evenly performed.

A difference between the shape of the heat exchange fin of the fin assembly 414 provided at the first heat exchanger unit 41*a* and the shape of the heat exchange fin of the fin assembly 424 provided at the second heat exchanger unit 42*a* has been described. The shape of the heat exchange fin of the fin assembly 414 provided at the first heat exchanger unit 41*a* may be different from the shape of the heat exchange fin of the fin assembly 424 provided at the second heat exchanger unit 42*a*, and a density of the fin assembly 414 provided at the first heat exchanger unit 41*a* may be higher than that of the fin assembly 424 provided at the second heat exchanger unit 42*a*.

A fin pitch and a fin shape of the fin assembly 414 provided at the first heat exchanger unit 41*a* may be determined variously to have an advantage in exchanging heat while the air flows at a high speed, and a fin pitch and a fin shape of the fin assembly 424 provided at the second heat exchanger unit 42*a* may be determined variously to have an advantage in exchanging heat while the air flows at a low speed.

Figure 6A:
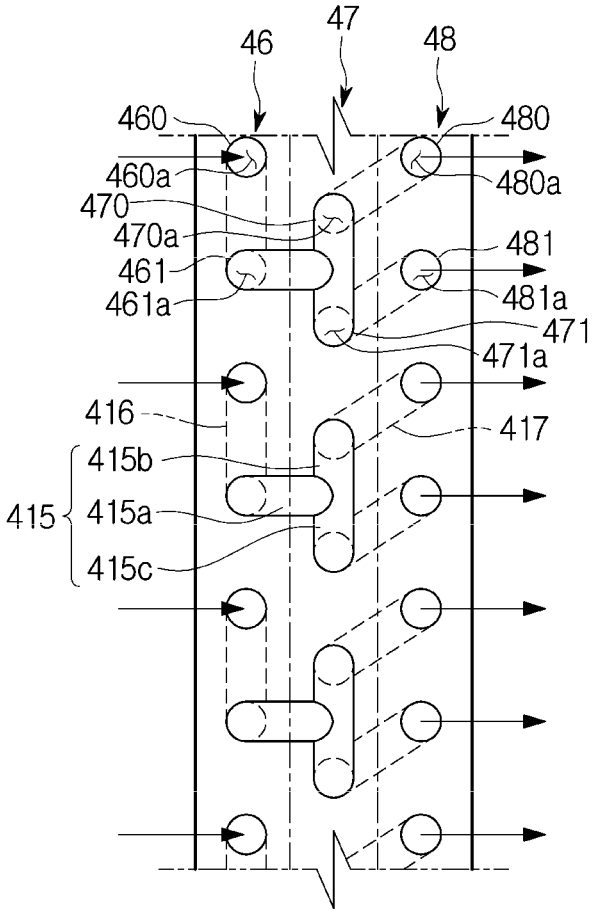
FIG. 6A is a view illustrating one end of the heat exchanger of FIG. 2.
Figure 6B:
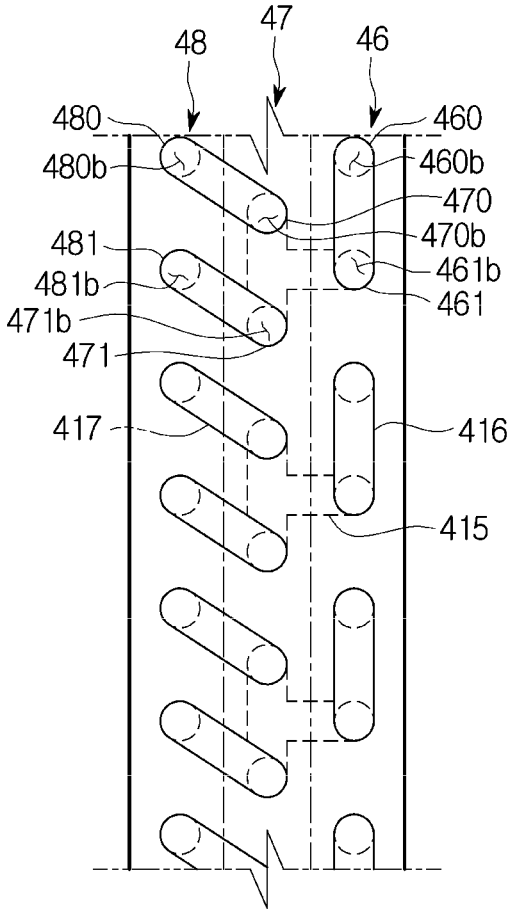
FIG. 6B is a view illustrating the other end of the heat exchanger of FIG. 2.

FIG. 6A is a view illustrating one end A of the heat exchanger of FIG. 2, and FIG. 6B is a view illustrating the other end B of the heat exchanger of FIG. 2.

Referring to FIGS. 6A and 6B, the heat exchanger 40 according to an embodiment may be formed by stacking a plurality of layers forward and backward. Each of the plurality of layers forming the heat exchanger 40 may include a plurality of refrigerant tubes and a fin assembly.

For example, the heat exchanger 40 of the outdoor unit 12 may be formed by stacking a first layer 46, a second layer 47 located inside the first layer 46 and a third layer 48 located inside the second layer 47 forward and backward.

The plurality of refrigerant tubes included in the first layer 46 and the plurality of refrigerant tubes included in the second layer 47 may be arranged to cross each other and thus not to be forward and backward overlapped with each other, and the plurality of refrigerant tubes included in the second layer 47 and the plurality of refrigerant tubes included in the third layer 48 are arranged to cross each other and thus not to be forward and backward overlapped with each other. It may be regarded that one end of the heat exchanger 40 corresponds to A in FIG. 2, and the other end of the outer heat exchanger corresponds to B in FIG. 2. The refrigerant may be introduced into a side of the refrigerant tubes provided at the first layer 46 and then may be discharged via the refrigerant tubes provided at the second layer 47 and the third layer 48.

A hole formed at one end of each of a first refrigerant tube 460 and a second refrigerant tube 461 of the plurality of refrigerant tubes in the first layer 46 which are disposed adjacent to each other may be referred to as a first hole 460*a* and a second hole 461*a*. A hole formed at one end of each of a first refrigerant tube 470 and a second refrigerant tube 471 which are disposed at the second layer 47 to be adjacent to the second refrigerant tube 461 of the first layer 46 may be referred to as a third hole 470*a* and a fourth hole 471*a*.

The refrigerant introduced into the first hole 460*a* of the first layer 46 at one end of the heat exchanger 40 flows through the first refrigerant tube 460 and the second refrigerant tube 461. At the other end of the heat exchanger 40, the first refrigerant tube 460 and the second refrigerant tube 461 may be connected by a U-shaped connection pipe 416. That is, holes 460*b* and 461*b* formed at the other ends of the first refrigerant tube 460 and the second refrigerant tube 461 may be connected by the U-shaped connection pipe 416.

At one end of the heat exchanger 40, the second refrigerant tube 461 of the first layer 46 may be connected to the first refrigerant tube 470 and the second refrigerant tube 471 of the second layer 47. That is, the second hole 461*a* may be connected to the third hole 470*a* and the fourth hole 471*a*.

The second hole 461*a*, the third hole 470*a* and the fourth hole 471*a* may be connected by a tripod-shaped connection pipe 415. The connection pipe 415 may include a first connection pipe 415*a* connected to the second hole 461*a*, a second connection pipe 415*b* branched from the first connection pipe 415*a* and connected to the third hole 470*a*, and a third connection pipe 415*c* branched from the first connection pipe 415*a* and connected to the fourth hole 471*a*.

The refrigerant discharged through the second hole 460*b* flows through the first connection pipe 415*a*, and the refrigerant in the first connection pipe 415*a* may be branched into and may flow through the second connection pipe 415*b* and the third connection pipe 415*c*. Accordingly, the refrigerant of which the phase is changed while passing through the first refrigerant tube 460 and the second refrigerant tube 461 of the first layer 46 may be distributed and introduced into the first refrigerant tube 470 and the second refrigerant tube 471 of the second layer 47.

The refrigerant introduced into the third hole 470*a* and the fourth hole 471*a* of the second layer 47 at one end of the heat exchanger 40 may pass through the first refrigerant tube 470 and the second refrigerant tube 471 and then may be introduced into a first refrigerant tube 480 and a second refrigerant tube 481 of the third layer 48 at the other end of the heat exchanger 40. That is, at the other end of the heat exchanger 40, the first refrigerant tube 470 of the second layer 47 may be connected to the first refrigerant tube 480 of the third layer 48, and the second refrigerant tube 471 of the second layer 47 may be connected to the second refrigerant tube 481 of the third layer 48.

Since the refrigerant tubes of the second layer 47 and the refrigerant tubes of the third layer 48 are arranged forward and backward to cross each other and thus not to be overlapped with each other, a hole 470*b* formed at the other end of the first refrigerant tube 470 of the second layer 47 may be diagonally connected to a hole 480*b* formed at the first refrigerant tube 480 of the third layer 48 by a U-shaped connection pipe 417, and a hole 471*b* formed at the other end of the second refrigerant tube 471 of the second layer 47 may be diagonally connected to a hole 481*b* formed at the second refrigerant tube 481 of the third layer 48 by the U-shaped connection pipe 417.

The refrigerant passed through each of the first refrigerant tube 480 and the second refrigerant tube 481 of the third layer 48 may be discharged to a fifth hole 480*a* formed at one end of the first refrigerant tube 480 and a sixth hole 481*a* formed at one end of the second refrigerant tube 481.

The refrigerant pipes 410 and 411 for supplying or collecting the refrigerant to/from the refrigerant tubes of the heat exchanger 40 may be provided at one end of the heat exchanger 40. The first refrigerant pipe 410 for distributing the refrigerant may be connected to the first refrigerant tube 460 of the first layer 46 at one end of the heat exchanger 40. Also, the second refrigerant pipe 411 for collecting the refrigerant may be connected to the first refrigerant tube 480 and the second refrigerant tube 481 of the third layer 48 at one end of the heat exchanger 40.

The refrigerant introduced from the first refrigerant pipe 410 into the first hole 460*a* of the first layer 46 flows reciprocatingly at the first layer 46 through the first refrigerant tube 460 an the second refrigerant tube 461, and the refrigerant discharged through the second hole 461*a* of the first layer 46 may be distributed and introduced into the third hole 470*a* and the fourth hole 470*b* of the second layer 47.

Since the refrigerant introduced into the third hole 470*a* flows at the second layer 47 and the third layer 48 through the first refrigerant tube 470 of the second layer 47 and the first refrigerant tube 480 of the third layer 48 in only one direction and may be discharged to the fifth hole 480*a* of the third layer 48, and the refrigerant introduced into the fourth hole 471*a* flows in only one direction through the second refrigerant tube 471 of the second layer 47 and the second refrigerant tube 481 of the third layer 48 and may be discharged to the sixth hole 481*a* of the third layer 48, a temperature of the refrigerant discharged to the fifth hole 480*a* and the sixth hole 481*a* may be uniform.

Since the temperature of the refrigerant discharged through the fifth hole 480*a* and the sixth hole 481*a* may be uniform, the heat exchange efficiency may be enhanced further than that of a conventional heat exchanger in which the temperature of the refrigerant discharged through each of discharge holes may be non-uniform. When a warming operation is performed, a problem due to frost generated on a surface of the heat exchanger may be improved.

Figure 7:
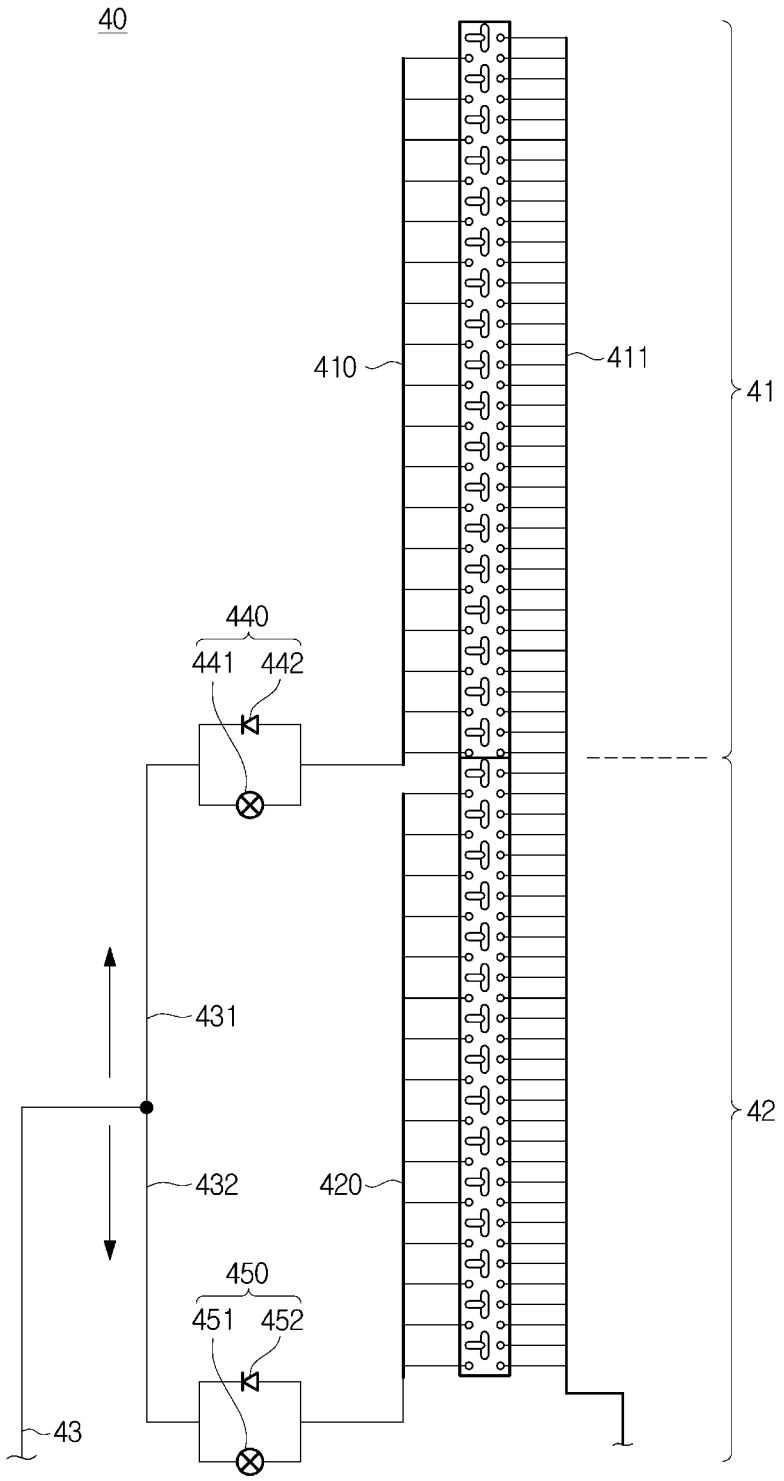
FIG. 7 is a view illustrating a state in which a valve for controlling a flow rate of an inflow refrigerant is provided at each of an upper portion and a lower portion of the heat exchanger according to an embodiment.

FIG. 7 is a view illustrating a state in which a valve for controlling a flow rate of the inflow refrigerant may be provided at each of an upper portion and a lower portion of the heat exchanger according to an embodiment.

As illustrated in FIG. 7, the heat exchanger 40 according to an embodiment may include a first valve unit 440 for controlling an amount of the refrigerant flowing to the first heat exchanger unit 41 located at the upper side and a second valve unit 450 for controlling an amount of the refrigerant flowing to the second heat exchanger unit 42 located under the first heat exchanger unit 41.

The refrigerant supplied toward the outdoor unit 12 through a supply pipe 43 connected to the refrigerant pipe 13 may be supplied toward the first heat exchanger unit 41 through a first branched pipe 431 and may also be supplied toward the second heat exchanger unit 42 through a second branched pipe 432. The first valve unit 440 may be provided between the first branched pipe 431 and the first refrigerant pipe 410 connected to the refrigerant tube of the first layer of the first heat exchanger unit 41, and thus the amount of the refrigerant supplied to the first refrigerant pipe 410 through the first branched pipe 431 may be adjusted. The second valve unit 450 may be provided between the second branched pipe 432 and a third refrigerant pipe 420 connected to the refrigerant tube of the first layer of the second heat exchanger unit 42, and thus the amount of the refrigerant supplied to the third refrigerant pipe 420 through the second branched pipe 432 may be adjusted.

Since the fan assembly 30 may be located at the upper portion of the heat exchanger 40, the flow speed of the air passing through the first heat exchanger unit 41 may be faster than that of the air passing through the second heat exchanger unit 42. Since the flow speed of the air at the side of the first heat exchanger unit 41 may be faster than that of the air at the side of the second heat exchanger unit 42, the more amount of the air exchanges heat for the same time at the side of the first heat exchanger unit 41. A controller (not shown) provided at the air conditioner 1 may control correspondingly the first valve unit 440 and the second valve unit 450 so that the more amount of the refrigerant per unit time flows toward the first heat exchanger unit 41.

Since the first heat exchanger unit 41 may be provided so that the more amount of the refrigerant per unit time than that at the second heat exchanger unit 42 flows, the heat exchange may be generally evenly performed in the heat exchanger 40.

The refrigerant supplied to the first heat exchanger unit 41 and the second heat exchanger unit 42 may be collected to the second refrigerant pipe 411. However, when the air conditioner 1 is used as a cooler, the refrigerant may be distributed to the first heat exchanger unit 41 and the second heat exchanger unit 42 through the second refrigerant pipe 411 and then may be collected through the first refrigerant pipe 410 and the third refrigerant pipe 420.

Therefore, the first valve unit 440 may include a first expansion valve 441 for expanding the refrigerant while controlling the amount of the refrigerant when the refrigerant is introduced into the first refrigerant pipe 410 and a first check valve 442 for allowing the flow of the refrigerant in only a discharging direction of the refrigerant when the refrigerant is discharged from the first refrigerant pipe 410.

Figure 8:
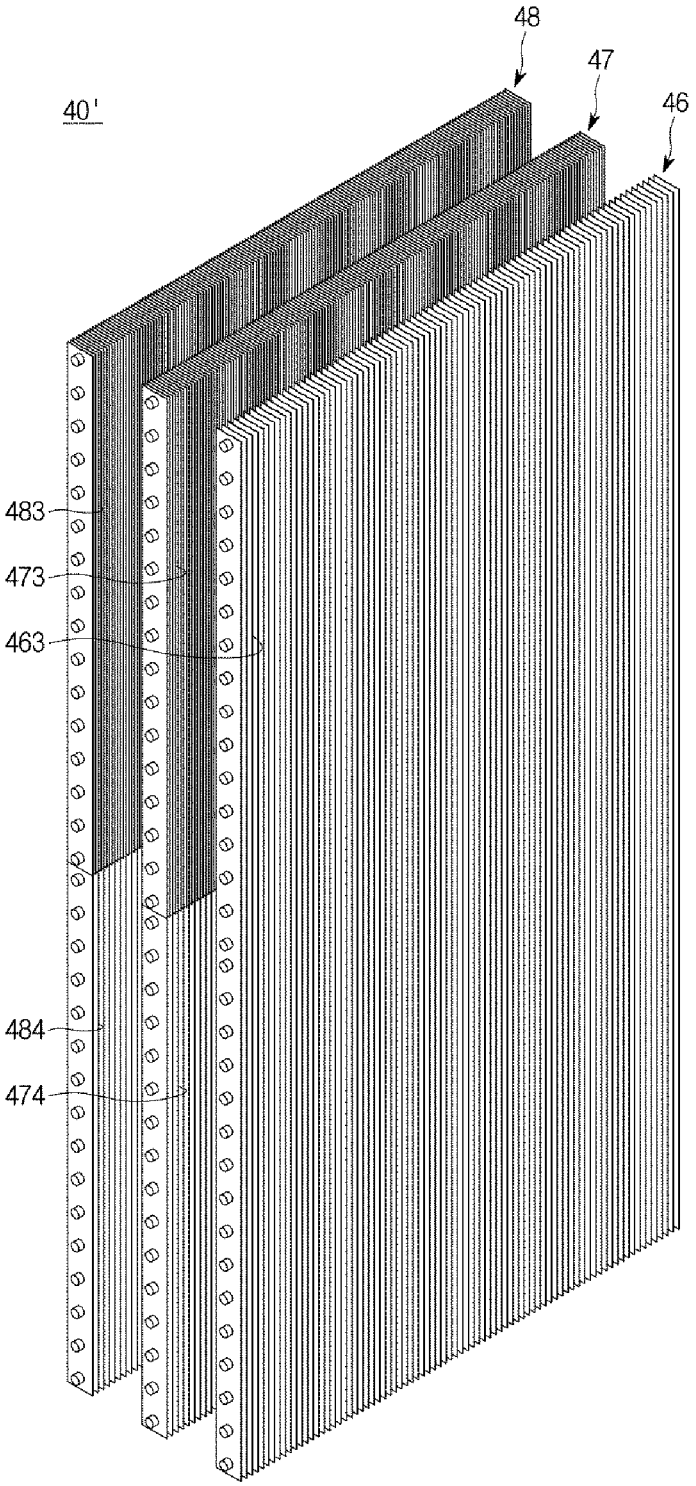
FIG. 8 is a view illustrating the heat exchanger according to another embodiment.

The second valve unit 450 may include a second expansion valve 451 for expanding the refrigerant while controlling the amount of the refrigerant when the refrigerant is introduced into the third refrigerant pipe 420 and a second check valve 452 for allowing the flow of the refrigerant in only the discharging direction of the refrigerant when the refrigerant is discharged from the third refrigerant pipe 420. FIG. 8 is a view illustrating the heat exchanger according to an embodiment.

As illustrated in FIG. 8, the heat exchanger 40' may be configured with a plurality of layers that are stacked forward and backward and each of which includes the plurality of refrigerant tubes. For example, the heat exchanger 40' may include the first layer 46, the second layer 47 located inside the first layer 46 and the third layer 48 located inside the second layer 47.

At least one of the plurality of layers forming the heat exchanger 40' may include a plurality of fin assemblies arranged vertically and formed by heat exchange fins having different fin pitches or shapes. For example, at least one of the first layer 46, the second layer 47 and the third layer 48 may include the plurality of fin assemblies arranged vertically and formed by the heat exchange fins having the different fin pitches or shapes.

The first layer 46 may include one fin assembly 463. That is, a fin assembly 463 of the first layer 46 may be provided to have a uniform density at the entire first layer 46.

First fin assemblies 473 and 483 disposed at upper portions of the second layer 47 and the third layer 48 may be configured with high-speed fins having the fin pitch and the fin shape which are advantageous to a high-speed air flow. Also, second fin assemblies 474 and 484 disposed at lower portions of the second layer 47 and the third layer 48 may be configured with low-speed fins having the fin pitch and the fin shape which are advantageous to a low-speed air flow.

Different types of fin assemblies having the different fin pitches may be provided at the upper and lower portions of the second layer 47 and the third layer 48, respectively. That is, the fin assembly located at the upper portion thereof may be provided so that the heat exchange fins are arranged densely further than those of the fin assembly located at the lower portion thereof.

The fin assemblies of at least two layers of the first layer 46, the second layer 47 and the third layer 48 of the heat exchanger unit 40' may be configured with the heat exchange fins having the different fin pitches or shapes from each other.

For example, the fin pitch of the fin assembly 463 provided at the first layer 46 may be provided larger than those of the fin assemblies 473 and 483 disposed at the upper portions of the second layer 47 and the third layer 48. That is, the heat exchange fins of the fin assemblies 473 and 483 disposed at the upper portions of the second layer 47 and the third layer 48 may be arranged densely more than those of the fin assembly 463 provided at the first layer 46.

The fin assembly 463 having the fin pitch greater than the density of each of the fin assemblies 473 and 483 located at the upper portions of the second layer 47 and the third layer 48 may be disposed at the entire first layer 46. Accordingly, the resistance of the air passing through the first layer 46 which is less influenced by the fan assembly 30 may be reduced, and thus the heat exchange may be more efficiently performed.

In the above description, the embodiment in which the fin pitch of the fin assembly 463 provided at the first layer 46 is larger than that of each of the fin assemblies 473 and 483 provided at the upper portions of the second layer 47 and the third layer 48 has been described. However, it may also be possible that the air resistance to the fin assembly 463 provided at the first layer 46 is formed smaller than that to each of the fin assemblies 473 and 483 provided at the upper portions of the second layer 47 and the third layer 48.

An example in which the heat exchanger 40 provided at the outdoor unit 12 includes the first heat exchanger unit 41 and the second heat exchanger unit 42 which are located at the upper and lower portions thereof has been described. The spirit of the present invention may also be similarly applied to a case in which three or more different types of heat exchangers are provided.

According to the heat exchanger according to an aspect of the present invention can enhance the cooling and warming performance of the air conditioner using the different types of heat exchangers.

The heat exchange efficiency can also be increased by enhancing uniformity of the flow speed of the air passing through the heat exchanger.

The difference in the temperature between the refrigerant pipes which exchange heat with the air can be reduced by improving a structure of the refrigerant pipe, and thus the heat exchange efficiency can be enhanced.

The flow speed of the refrigerant passing through the refrigerant pipe can be controlled by the valve, and thus the heat exchange efficiency can be enhanced.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An air conditioner comprising:

an outdoor unit of the air conditioner including a heat exchanger and a fan assembly, wherein the heat exchanger includes a first layer, a second layer, and a third layer, which are stacked together so that the third layer is disposed inside of the second layer which is disposed inside of the first layer, wherein each of the first layer, the second layer, and the third layer includes a plurality of refrigerant tubes and a fin assembly, and is formed so that if refrigerant is introduced in the plurality of refrigerant tubes of the first layer, the refrigerant is discharged into two refrigerant tubes of the second layer and flows in one direction, wherein if refrigerant flows through the second layer in the one direction, the refrigerant is delivered to the third layer and flows in the one direction, wherein the fan assembly is disposed at an upper portion of the heat exchanger, and the heat exchanger includes a plurality of heat exchangers disposed vertically, wherein the plurality of heat exchangers include fin assemblies configured with fins having at least one of different fin pitches or different shapes, wherein the heat exchanger includes a first heat exchanger disposed adjacent to the fan assembly and a second heat exchanger disposed under the first heat exchanger, and wherein the fin assembly of the first heat exchanger has a fin pitch, and the fin assembly of the second heat exchanger has a fin pitch which is greater than the fin pitch of the first heat exchanger so that more fins are disposed in the first heat exchanger in order to lower the speed of airflow through the first heat exchanger to correspond to the speed of airflow through the second heat exchanger.

2. The air conditioner according to claim 1, wherein a heat exchange fin of the fin assembly of the first heat exchanger is formed in a shape having a wider area and higher resistance to air than a heat exchange fin of the fin assembly of the second heat exchanger.

* * * * *